United States Patent [19]

Best et al.

[11] 4,313,320

[45] Feb. 2, 1982

[54] RIM LOCK WITH CLASSROOM FUNCTION

[75] Inventors: Walter E. Best; William R. Foshee, both of Indianapolis, Ind.

[73] Assignee: Best Lock Corporation, Indianapolis, Ind.

[21] Appl. No.: 965,186

[22] Filed: Nov. 30, 1978

[51] Int. Cl.[3] ..... E05B 65/06; E05B 65/10

[52] U.S. Cl. ..... 70/134; 70/92; 70/DIG. 27; 70/DIG. 42; 292/92; 292/DIG. 65

[58] Field of Search ..... 70/129, 134, 92, DIG. 27, 70/DIG. 42; 292/92, DIG. 62, DIG. 65

[56] References Cited

U.S. PATENT DOCUMENTS

| | | | |
|---|---|---|---|
| 1,495,820 | 5/1924 | Tierney | 70/DIG. 42 X |
| 1,908,980 | 5/1933 | Heyel | 70/DIG. 42 X |
| 2,136,539 | 11/1938 | Brinton | 70/DIG. 42 X |
| 4,047,408 | 9/1977 | Johns et al. | 70/129 |

*Primary Examiner*—William E. Lyddane
*Attorney, Agent, or Firm*—Jenkins, Coffey, Hyland, Badger & Conard

[57] ABSTRACT

An improved and simplified dead bolt rim lock, which provides "classroom function". A dead bolt is fixed on a draw plate slidable in a rim lock case and having a cross slot which extends one way from center and is engaged by a crank pin movable in an 180° arc between front and rear centered positions. The crank pin is on a crank arm carried by a turnknob rotatable in the rim lock case, and its projecting end lies in the path of a cam mounted for rotation in the back plate of the case and connected for operation from a key-actuated cylinder mounted in the outside face of the door. For classroom function, the turnknob has a limited throw and has lost motion relative to the crank arm so as to allow retraction of the bolt by the turnknob but prevent its advancement thereby to locked position.

9 Claims, 4 Drawing Figures

FIG. 2
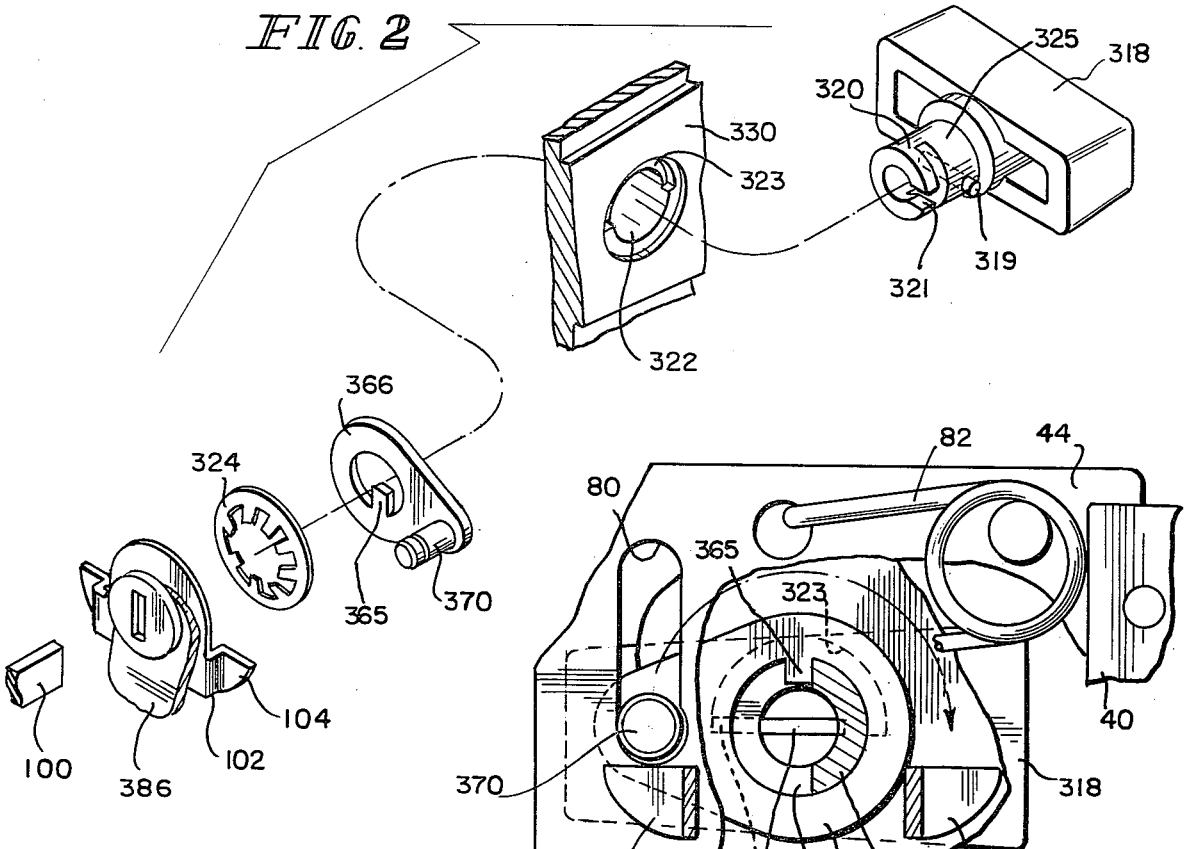
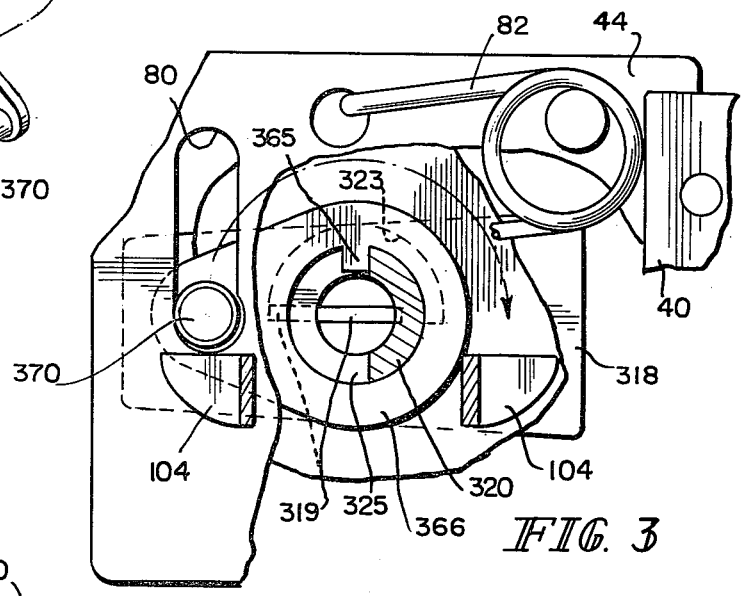
FIG. 3
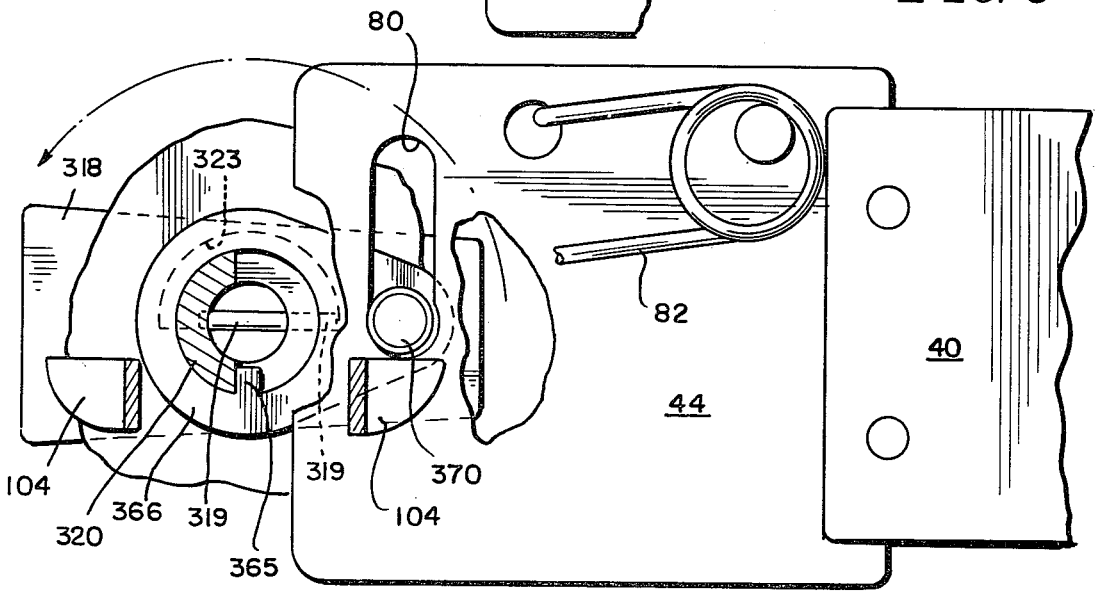
FIG. 4

RIM LOCK WITH CLASSROOM FUNCTION

This invention relates to rim locks, and especially to dead bolt rim locks.

It is the general object of the invention to provide an improved dead bolt rim lock which will give the appearance of having, and will have, considerable sturdy strength, which will be of improved construction and will have improved operation. It is a further object of the invention to provide a rim lock having an inside turnknob which provides a "classroom function" that permits the bolt to be retracted from the inside face of the door but prevents the bolt from being advanced to locked position by the turnknob at the inside face of the door.

In accordance with the invention, the rim lock comprises a case in the form of a rearwardly open box closed by a back plate. A dead bolt is fixed to a draw plate to form a one-piece element which is movable between advanced and retracted positions. The draw plate has a cross slot extending one way from center and engaged over a crank pin on a crank arm carried by an inside turnknob rotatable relative to the rim lock case. The projecting end of the pin lies in the path of a cam rotatably mounted in the back plate and adapted to be connected by a throw member to a cylinder actuated by a key from the opposite face of the door. The crank pin is movable in a 180° arc between front and rear centered positions, and is biased to centered position by a spring mounted on the draw plate. For classroom function, the turnknob has a limited throw of say 180° relative to the case, and has a similar amount of lost motion relative to the crank arm, and such throw limit and lost motion are so interrelated that the turnknob is operable to retract the bolt but is inoperable to advance it.

The accompanying drawings illustrate the invention and show the best mode of carrying out the invention as presently perceived. In such drawings:

FIG. 2 is an exploded view of a turnknob construction which provides "classroom function", shown in relation to the front wall of the case in which the turnknob is mounted and in association with the bolt-operating crank arm and with the key-operated cam, and with the parts in an orientation correlated with FIGS. 3 and 4;

Figure 1:
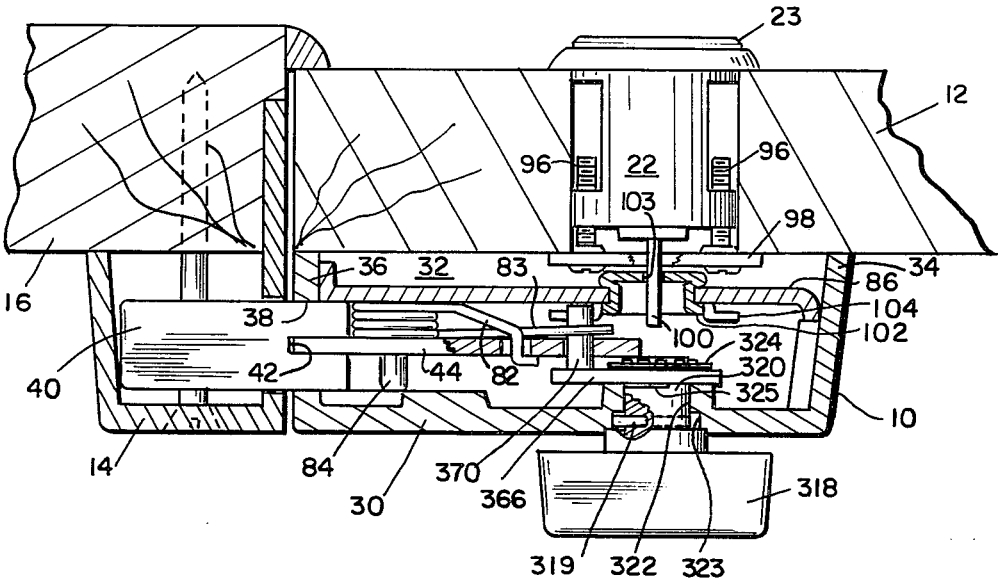
FIG. 1 is a horizontal sectional view of a rim lock embodying the invention, shown mounted on a door and in relation with a cooperative strike.

FIG. 3 is a fragmental rear elevation with parts broken away of the apparatus which provides classroom function, with the parts analogous to those of FIG. 1 shown in an orientation obtained by rotating the rim lock of FIG. 1 through 180° about a vertical axis so as to dispose the dead bolt at the right, the dead bolt being shown in advanced position; and FIG. 4 is a view similar to FIG. 3 with the bolt in retracted position.

The rim lock shown in FIGS. 1–4 comprises a case 10 mounted on a door 12 and adapted to be locked to a strike 14 mounted on a doorjamb 16. The lock case 10 comprises a front wall 30, side walls 32, a rear end wall 34, and a front end wall 36. The latter is formed with a bolt opening 38 adapted to pass the head of a dead bolt 40. The rear of such head is formed with a transverse slot 42 which receives the front end of a draw plate 44 to which the head is integrally attached by a pair of pins.

A crank arm 366 is mounted for rotation in the front wall 30 of the case, with its crank pin 370 extending through the plane of the bolt draw plate 44. Such draw plate is formed with a cross slot 80 which extends tangentially of the pin path, in one direction from the longitudinal center line containing the crank axis, and is received over a crank pin 370. The crank pin 370 has a peripheral groove just above the plate 44, which is engaged by one leg 83 of a hair-pin-shaped centering spring 82 which is wound loosely around a supporting pin 84 on the plate 44 and has its opposite end engaged through a hole in that plate. The pin 370 is thus biased to a centered position in the inner end of the cross slot, where in both locked and unlocked positions it positively blocks forced retraction and advance of the dead bolt 40. To assist in maintaining the pin in that centered position when the bolt is in advanced position, the cross slot 80, at its center end, is formed with a shallow detent notch into which the crank pin 370 will seat in the event of inward thrust on the bolt 40.

An outside cylinder 22 is mounted in a bored opening in the door 12. The cylinder 22 is of a standard type with a front rim 23 and is held in place with a pair of bolts 96 which extend through a clamp plate 98 lying against the inside face of the door. The cylinder is provided with a spade connector 100 which extends through the clamp plate 98 for operating the lock by key actuation of the front cylinder 22.

To effect operation of the rim lock from the outside of the door, a T-shaped cam 102 is rotatably mounted in an opening in the back plate 86 of the case. The T-shaped cam includes two operating fingers 104 which are offset from the body of the cam so as to engage the upper end of the crank pin 370. The web of the cam is formed with a slot 103 to receive the spade connector 100 which transmits motion from the key plug of the outer cylinder 22. FIG. 1 shows the cam 102 in its normal position, which it takes when the key plug of the outer cylinder 22 is in its locked, key-removal position.

The case 10 is fitted with an inside turnknob 318 integral with a spindle 320 which is rotatably mounted in an opening 322 formed in the front wall 330 of the case. The inner end of the spindle carries the crank arm 366 with the crank pin 370 at its end. The crank arm is retained on the spindle by a keeper 324. The crank pin 370 of the turnknob 318 extends through the slot 80 of the draw plate, and therebeyond into close proximity with the back plate 86 and into the path of the actuating fingers 104 of the cam 102.

The rim lock provides "classroom function," in which the inside turnknob is operable to retract the bolt but not operable to advance the bolt, so that the bolt can be advanced to locked position only by a key in the outside cylinder. To this end, the spindle 320 of the inside turnknob 318 is provided with a stop pin 319, and the opening 322 in the front wall 330, in which the turnknob is rotatably mounted, is formed with a rabbet groove 323 over half its circumference. The stop pin 319 rides in such groove 323, and the groove limits rotation of the turnknob 318° to 180° of rotation. The spindle 320 is also provided with a cross slot 325 over half its circumference, and such cross slot lies at the inner end of and communicates with an axial slot 321 which extends to the end of the spindle. The crank arm 366 has an inward tongue 365 adapted to enter through the axial slot 321 and ride in the cross slot 325.

Operation of this classroom function rim lock is as follows. In the condition of the parts as shown in FIG.

3, the bolt is advanced to its projected position, and the crank pin 370 lies in a forward centered position. The stop pin 319 on the turnknob spindle 320 lies at the clockwise end of the rabbet groove 323 in the case wall, and hence the turnknob is blocked from further rotation clockwise, but is free to rotate 180° counterclockwise. Also, the drive tongue 365 of the crank arm 366 lies at the clockwise end of the slot 325, in abutting relation with the solid portion of the spindle in the plane of that cross slot, so that rearward or counterclockwise rotation of the turnknob and spindle through the permitted 180° of rotation will drive the crank arm 366 counterclockwise from the position shown in FIG. 20, and this will move the draw plate 44 and the bolt 40 to retracted position, as shown in FIG. 4. The bolt can thus be retracted by manual actuation of the turnknob 318.

In contrast to this, manual actuation of the turnknob cannot advance the bolt. When the parts are in the condition shown in FIG. 4, the stop pin 319 is at the counterclockwise end of the rabbet groove 323, so that it is free to move only clockwise and only 180° from that position. The drive tongue 365 of the crank arm 366 is at the clockwise end of the cross slot 325 in the spindle 320, and clockwise rotation of that spindle, to which it is limited, will carry the solid section of that spindle 320 away from the drive finger 365, through 180° of lost motion relative to the crank arm 366, and no motion will be transmitted from the spindle to the crank arm 366 or its crank pin. Accordingly, forward or clockwise rotation of the turnknob 318 from the position shown in FIG. 4 will have no effect, and it will not be possible to advance the bolt 40 from its retracted position shown in FIG. 4 by manual actuation of the turnknob. Instead, the crank pin 370 will remain at the inner end of the cross slot 80, to which it is biased by the centering spring 82.

In either condition of the parts as shown in FIGS. 3 and 4, the bolt will, however, be operable by key actuation of the outside cylinder 22. Such key actuation will rotate the spade connector 100, which in turn will rotate the cam 102 with its opposite actuating fingers 104 from the normal position shown in FIGS. 20 and 21. If the bolt is retracted as shown in FIG. 4, the left-hand actuating finger 104, when rotated clockwise by key operation of the cylinder 22, will engage the eccentric pin 370 and will drive it 180° from the position shown in FIG. 4 to the position shown in FIG. 3, and this will advance the bolt 40. Such rotation of the crank pin 370 and the crank arm 366 will also take up the lost motion between the crank arm and the spindle 320 of the turnknob 318 and will position the parts as shown in FIG. 3. With the parts in that position, the cylinder 22 can be key-actuated to rotate the cam 102 rearward to carry its actuating finger 104 shown at the right in FIG. 3 counterclockwise through 180°, so as to drive the crank pin 370 from its position in FIG. 3 to its position in FIG. 4, and to retract the bolt 40.

We claim:

1. A dead bolt rim lock providing classroom function, comprising a case having a front wall, a dead bolt including an integrally connected draw plate, mounted for sliding movement between a projected locking position and a retracted unlocked position, said draw plate extending rearward in the case and having a cross slot therein, a crank arm mounted for rotation in a plane between the front wall and draw plate, a crank pin on said crank arm extending into said slot, said crank pin having a forward centered position substantially on a longitudinal center line intersecting the axis of rotation of the crank arm when the bolt is in projected position and having a rearward centered position when the bolt is in retracted position, the cross slot having an inner end to contain the crank pin in such centered positions, and extending one way transversely of said center line to allow the pin to move out lengthwise of the slot as the pin swings through 180° between its said centered positions, a turnknob spindle rotatably mounted through the front wall of the case, the crank arm being mounted on the inner end of the spindle, and a turnknob on the spindle, said crank arm being mounted on said spindle by means providing rotational lost motion therebetween through an angle at least equal to the throw of the crank pin between its centered positions, means to limit rotation of the turnknob relative to the case, said lost motion and rotation limiting means being so related that the turnknob is operative to retract the bolt and inoperative to advance it.

2. A dead bolt rim lock as in claim 1, in which said lost motion means provides 180° of lost motion and said rotation limiting means limits rotation to an equivalent angle.

3. A rim lock as in claim 1 in which the turnknob spindle carries a stop pin and the case forms an arcuate path through which said stop pin may swing, the ends thereof limiting rotation of the spindle, and the crank arm is rotatably mounted on the spindle and carries a drive finger which rides in a slot in the spindle to provide said lost motion, the relationship being such that when the bolt is in its advanced position, the turnknob is at the forward end of its limited rotation and the lost motion between the crank arm and spindle is taken up so that reverse rotation of the turnknob retracts the bolt, while in the retracted position of the bolt, forward rotation of the turnknob carries it through lost motion relative to the crank arm so that the turnknob is inoperative to advance the bolt.

4. A dead bolt rim lock providing classroom function, comprising a case and a deadbolt slidable in the case between a projected locking position and a retracted unlocked position, a spindle rotatable in the case and having a turnknob on its outer end, a crank arm mounted on the spindle and connected to project the bolt by forward rotation through a throw angle and to retract the bolt by rearward rotation through such angle, means for limiting rotation of the turnknob through an angle at least as great as said throw angle, the connection by way of the spindle between the turnknob and the crank arm being such as to provide lost motion through an angle at least equal to said throw angle, the relationship being such that when the bolt is in projected position, the turnknob is adjacent the forward end of its limited rotation and is rotatable rearward through said throw angle, and said lost motion is sufficiently taken up that such rearward turnknob rotation will actuate the crank arm to retract the bolt, and when the bolt is in retracted position, forward rotation of the turnknob through its limited angle will carry it through lost motion relative to the crank arm so that such turnknob rotation will be inoperative to advance the bolt.

5. A rim lock as in claim 4 with the addition of key-actuable means for advancing the bolt.

6. A rim lock as in claim 4 in which the turnknob is fixed on the spindle, the spindle is rotatable in a bearing in the case, the case contains a circumferential groove of limited length opening toward the spindle and the spindle carries a stop pin which rides in said groove so that the length of the groove limits the rotation of the spindle, and the crank arm is mounted for limited rotation on the spindle to provide said lost motion.

7. A dead bolt rim lock providing classroom function, comprising a case having a front wall, a dead bolt including an integrally connected draw plate, mounted for sliding movement between a projected locking position and a retracted unlocked position, said draw plate extending rearward in the case and having a cross slot therein, a spindle rotatable in the case and a crank arm mounted on said spindle for rotation in a plane between the front wall and draw plate, a crank pin on said crank arm extending into said slot, said crank pin having a forward centered position substantially on a longitudinal center line intersecting the axis of rotation of the crank arm when the bolt is in projected position and having a rearward centered position when the bolt is in retracted position, the cross slot having an inner end to contain the crank pin in such centered position, and extending one way transversely of said center line to allow the pin to move out lengthwise of the slot as the pin swings through 180° between its said centered positions, and a centering spring mounted on said draw plate for biasing said crank pin toward the inner end of the slot, said crank pin by its engagement with the slot in said centered positions acting to block sliding movement of the bolt, and the crank pin being operative to directly drive the bolt between retracted and advanced positions in its rotation between said centered positions, means at the front of the case for rotating the spindle, said crank arm being mounted for limited rotation on said spindle so as to provide lost motion therebetween, and said spindle being mounted for limited rotation in said case wall, the relationship being such that the spindle-rotating means is effective to retract the bolt but is ineffective to project the bolt.

8. A rim lock as in claim 7 with the addition of a key-actuable cylinder adapted for mounting in the opposite face of a door from the mounting of the case, and means for connecting the cylinder to drive the crank arm both to project and to retract the bolt.

9. A rim lock as in claim 7 in which the crank pin moves through an over-center position relative to the centering spring, so that the centering spring tends to drive the crank arm to both its centered positions and thereby to drive the bolt to its projected and retracted positions.

* * * * *